US008141398B2

(12) United States Patent
Ookawara et al.

(10) Patent No.: US 8,141,398 B2
(45) Date of Patent: Mar. 27, 2012

(54) SIDE LOCK APPARATUS

(75) Inventors: Toshihiko Ookawara, Kanagawa (JP); Toshihiro Shimizu, Kanagawa (JP)

(73) Assignee: Piolax Inc., Yokohama-Shi, Kanagawa (JP)

( * ) Notice: Subject to any disclaimer, the term of this patent is extended or adjusted under 35 U.S.C. 154(b) by 738 days.

(21) Appl. No.: 11/641,968

(22) Filed: Dec. 20, 2006

(65) Prior Publication Data

US 2007/0163310 A1 Jul. 19, 2007

(30) Foreign Application Priority Data

Dec. 21, 2005 (JP) ..... P2005-368839

(51) Int. Cl.
*E05B 13/10* (2006.01)

(52) U.S. Cl. ..... 70/208; 292/121; 292/109

(58) Field of Classification Search ..... 292/32, 292/121, 109; 70/208
See application file for complete search history.

(56) References Cited

U.S. PATENT DOCUMENTS

| | | | | |
|---|---|---|---|---|
| 4,037,440 | A * | 7/1977 | Shabtai et al. | 70/108 |
| 7,048,311 | B2 * | 5/2006 | Sawatani et al. | 292/33 |
| 7,454,933 | B1 * | 11/2008 | Paige et al. | 70/208 |
| 7,455,333 | B2 * | 11/2008 | Ookawara | 292/34 |
| 7,695,028 | B2 * | 4/2010 | Katou et al. | 292/34 |

FOREIGN PATENT DOCUMENTS

| | | | |
|---|---|---|---|
| JP | 4-71343 | U | 6/1992 |
| JP | 2002-106225 | * | 4/2002 |
| JP | 2002-106225 | A | 4/2002 |
| JP | 2004-210260 | A | 7/2004 |
| JP | 2004-211383 | | 7/2004 |
| JP | 2005-9301 | * | 1/2005 |
| JP | 2005-009301 | A | 1/2005 |
| JP | 2005-127020 | A | 5/2005 |

OTHER PUBLICATIONS

Japanese Office Action dated Nov. 22, 2010 (with English translation).

* cited by examiner

*Primary Examiner* — Kristina Fulton
(74) *Attorney, Agent, or Firm* — McGinn IP Law Group, PLLC

(57) ABSTRACT

A side lock apparatus includes: a housing which is fixed to a lid; a disc-shaped rotor which is supported on the housing; and rods which are linked with the rotor, wherein: the housing includes: a bearing portion for the rotor which is provided in such a manner as to extend vertically along the short upper portion of the lid; a first wall; a second wall; and a cylindrical portion which is brought into sliding contact with a disc-shaped outer circumferential surface of the rotor to support the rotor; the rotor is supported on the bearing portion in such a manner that the disc shape thereof becomes horizontal relative to a wall thickness direction of the short upper portion of the lid; and the rods are supported between the first wall and the second wall in such a manner as to slide in an opposite direction.

15 Claims, 14 Drawing Sheets

SIDE LOCK APPARATUS

BACKGROUND OF THE INVENTION

1. Field of the Invention

The present invention relates to a side lock apparatus for locking, for example, a glove box itself which is mounted in an instrument panel of a motor vehicle in such a manner as to be opened and closed or an independent lid thereof.

2. Description of the Related Art

Although not shown specifically, conventionally, a side lock apparatus of this type is constructed such that a pinion gear is rotatably supported within a housing which is fixed to a glove box main body's side, proximal end portions of a pair of left and right rods are provided in such a manner as to move back and forth, racks formed on surfaces of the proximal end portions of the rods are brought into mesh engagement with the pinion gear from opposite directions, while one of the rods is biased in a direction towards a lock hole opened in an instrument panel by virtue of a biasing spring pressure, and an operation knob is provided on a front surface of the glove box main body, whereby the operation knob can be operated to withdraw the other rod against the biasing spring pressure (refer to, for example, JP-A-2004-211383).

In such a state that the glove box main body is closed, distal end portions of the pair of left and right rods stay in corresponding lock holes in the instrument panel in an engaged fashion by virtue of the biasing spring pressure, so as to lock the glove box in its closed position. Then, when this locked state is released to open the glove box, the operation knob is operated to withdraw the other rod against the biasing spring pressure so that the distal end portion of the rod is withdrawn from the corresponding lock hole. As this occurs, the pinion gear rotates, and the remaining rod moves in association with the rotation of the pinion gear to withdraw its distal end portion from the corresponding lock hole in the similar way as the other rod, whereby the glove box main body can be moved in an opening direction.

SUMMARY OF THE INVENTION

Consequently, in the conventional side lock apparatus, in particular, due to the reason that the pinion gear is disposed in the horizontal state, the mounting space needs a larger depth, but there is provided an advantage that the mounting space can be made relatively small in a vertical direction. However, in assemblage of the left and right racks to the pinion gear, it becomes remarkably difficult to synchronize the positions of the pair of racks, and hence, not only the number of manhours required for the assemblage becomes enormous but also there has been a risk that a delay may be caused, in particular, between operations of the pair of left and right rods.

The invention is developed to effectively solve the problem which is inherent in the conventional side lock apparatus, and according to a first aspect of the invention, there is provided a side lock apparatus for opening and closing a lid that includes a long lower portion and a short upper portion which continues from the long lower portion in a bent fashion as viewed in a vertical section, the side lock apparatus including: a housing which is fixed to a rear surface side of the short upper portion of the lid; a disc-shaped rotor which is rotatably supported on the housing; and a pair of left and right rods which are linked with the rotor in such a manner as to move back and forth as the rotor rotates, wherein: the housing includes: a bearing portion for the rotor which is provided in such a manner as to extend vertically along the short upper portion of the lid; a first wall and a second wall which face the bearing portion while defining a space therebetween; and a cylindrical portion which is brought into sliding contact with a disc-shaped outer circumferential surface of the rotor to support the rotor; the rotor is rotatably supported on the bearing portion in such a manner that the disc shape thereof becomes horizontal relative to a wall thickness direction of the short upper portion of the lid; and the pair of left and right rods are supported between the first wall and the second wall which define the space therebetween in such a manner as to slide in an opposite direction.

According to a second aspect of the invention, there is provided a side lock apparatus according to the first aspect of the invention, further including: a circumferential groove, in which an O ring is mounted, formed along the disc-shaped outer circumferential surface of the rotor; and a pair of connecting grooves, to which the pair of left and right rods are connected, provided in a radial direction of the rotor and disposed on opposite sides of a face of the rotor, wherein an outer end of each of the connecting grooves is made to communicate with the circumferential groove.

According to a third aspect of the invention, there is provided a side lock apparatus for opening and closing a lid that includes a long lower portion and a short upper portion which continues from the long lower portion in a bent fashion as viewed in a vertical section, the side lock apparatus including: a housing which is fixed to a rear surface side of the short upper portion of the lid; a disc-shaped rotor which is rotatably supported on the housing; and a pair of left and right rods which are linked with the rotor in such a manner as to move back and forth as the rotor rotates, wherein: the housing has a bearing portion for the rotor which is provided in such a manner as to extend vertically along the short upper portion of the lid and a first wall and a second wall which face the bearing portion while defining a space therebetween; the rotor is rotatably supported on the bearing portion in such a manner that the disc shape thereof becomes horizontal relative to a wall thickness direction of the short upper portion of the lid; the pair of left and right rods are supported between the first wall and the second wall which define the space therebetween in such a manner as to slide in an opposite direction; and an operation unit is provided on one of the pair of left and right rods which lies farther away from a surface of the lid.

According to a fourth aspect of the invention, there is provided a side lock apparatus according to the third aspect of the invention, wherein the operation unit is a tilt type and is made to interfere with the rod which lies farther away from the surface of the lid.

Consequently, in the first aspect of the invention, since the rotor is rotatably supported in the horizontal state relative to the housing, although the mounting space needs to have a larger depth, the mounting space is largely reduced in the vertical direction, and therefore, there can be provided the optimum side lock apparatus as one that is mounted on a rear side of the short upper portion of the lid. In addition to this, due to the reason that the rotor is used to replace the conventionally used pinion gear, there can be eliminated a fear of an erroneous assemblage of the rods, and due to the reason that the cylindrical portion is provided on the housing which is brought into sliding contact with the disc-shaped outer circumferential surface of the rotor to support the rotor, there occurs no case where the rotor is inclined during operation, thereby making it possible to provide a good operability and a high-quality feel.

In the second aspect of the invention, even though an O ring is compressed excessively as the length and/or thickness of the O ring varies, a bottom-side diameter of the circumferential groove varies, or an inside diameter of the cylindrical portion of the housing varies, since the O ring can escape into the connecting grooves which communicate with the circumferential groove therefor, there occurs no case where a frictional resistance with the cylindrical portion is increased. In addition, since the usage of the O ring itself can help absorb uncomfortable noise that is produced as the rotor rotates, this will help effectively deal with such noise.

Also, in the third aspect of the invention, since the rotor is rotatably supported in the horizontal state relative to the housing, although the mounting space needs to have a larger depth, the mounting space is largely reduced in the vertical direction, and therefore, there can be provided the optimum side lock apparatus as one that is mounted on a rear side of the short upper portion of the lid. In addition to this, due to the reason that the rotor is used to replace the conventionally used pinion gear, there can be eliminated a fear of an erroneous assemblage of the rods. Furthermore, due to the reason that the operation unit is provided on one of the pair of left and right rods which lies farther away from the surface of the lid, the operation unit can be disposed by making use of a limited space on the rear surface of the short upper portion of the lid, and therefore, there occurs no case where the operation unit appears from the surface of the lid inadvertently.

In the fourth aspect of the invention, due to the reason that the operation unit of the tilt type is made to interfere with the rod which lies farther away from the surface of the lid, the operation unit is allowed to interfere with the rod at a location which is away from a tilting center of the operation unit, and therefore, a large lever ratio can be obtained, whereby the opening of the lid can be ensured.

BRIEF DESCRIPTION OF THE DRAWINGS

These and other objects and advantages of this invention will become more fully apparent from the following detailed description taken with the accompanying drawings in which.

DETAILED DESCRIPTION OF THE EMBODIMENTS

The invention is intended to provide an optimum side lock apparatus which is mounted on a rear side of a short upper portion of a lid for a glove box by providing a side lock apparatus for opening and closing a lid which has, as viewed in a vertical section, a long lower portion and a short upper portion which continues from the long lower portion in a bent fashion, including a housing which is fixed to a rear surface side of the short upper portion of the lid, a disc-shaped rotor which is rotatably supported on the housing, and a pair of left and right rods which are linked with the rotor in such a manner as to move back and forth as the rotor rotates, wherein the housing has a bearing portion for the rotor which is provided in such a manner as to extend vertically along the short upper portion of the lid and a first wall and a second wall which face the bearing portion while defining a space therebetween, the rotor is rotatably supported on the bearing portion in such a manner that the disc shape thereof becomes horizontal relative to a wall thickness direction of the short upper portion of the lid, and the pair of left and right rods are supported between the first wall and the second wall which define the space therebetween in such a manner as to slide in an opposite direction, while the housing has further a cylindrical portion which is brought into sliding contact with a disc-shaped outer circumferential surface of the rotor to support the rotor.

Figure 1A:
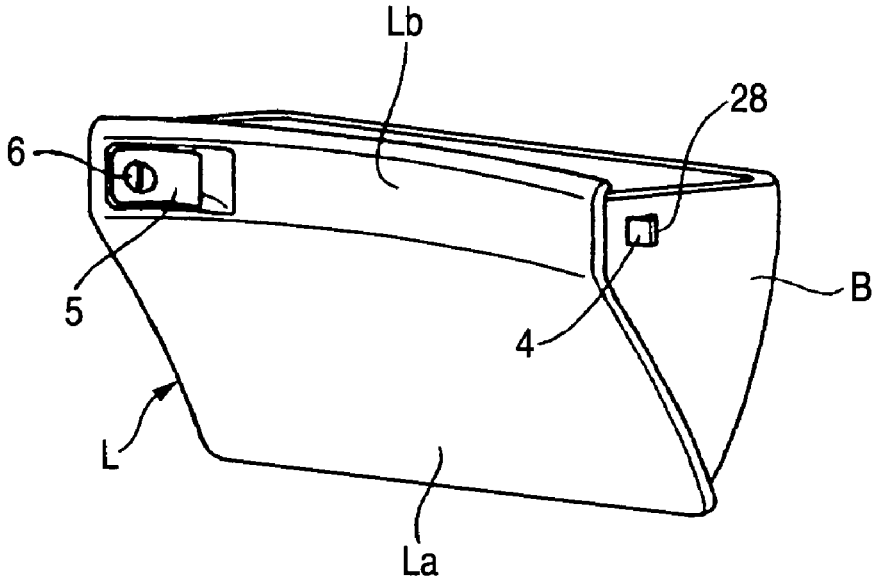
FIG. 1A is a perspective view of a glove box to which a side lock apparatus according to an embodiment of the invention is applied.
Figure 1B:
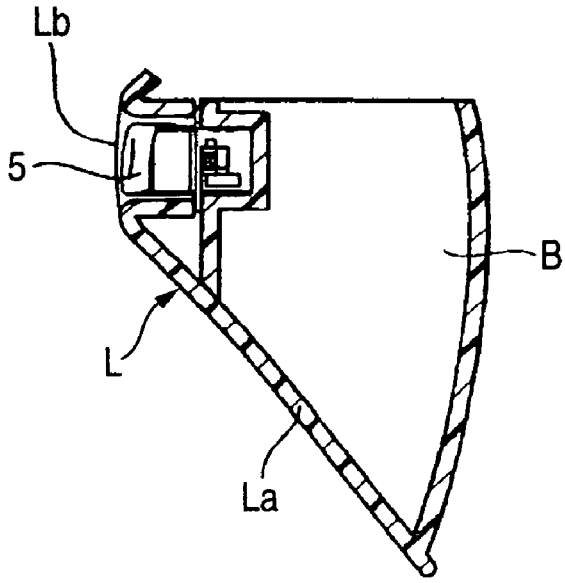
FIG. 1B is a vertical sectional view of the side lock apparatus.

Hereinafter, the invention will be described in detail based on a preferred embodiment which is shown in the accompanying drawings. As is shown in FIGS. 1A and 1B, a side lock apparatus according to this embodiment is such as to be developed for a glove box main body B having a lid L which has, as viewed in a vertical section thereof, an inclined long lower portion La and a short upper portion Lb which continues from the inclined long lower portion while bending therefrom to erect vertically. In this case, since the side lock apparatus can be disposed on only a rear surface of the short upper portion Lb of the lid L, a mounting space for the side lock apparatus can have more or less a large depth but is limited largely in a vertical direction, and this requires strongly the side lock apparatus itself to be made compact in the vertical direction. Thus, the side lock apparatus, which will be described below, has been developed based on these situations.

Figure 2:
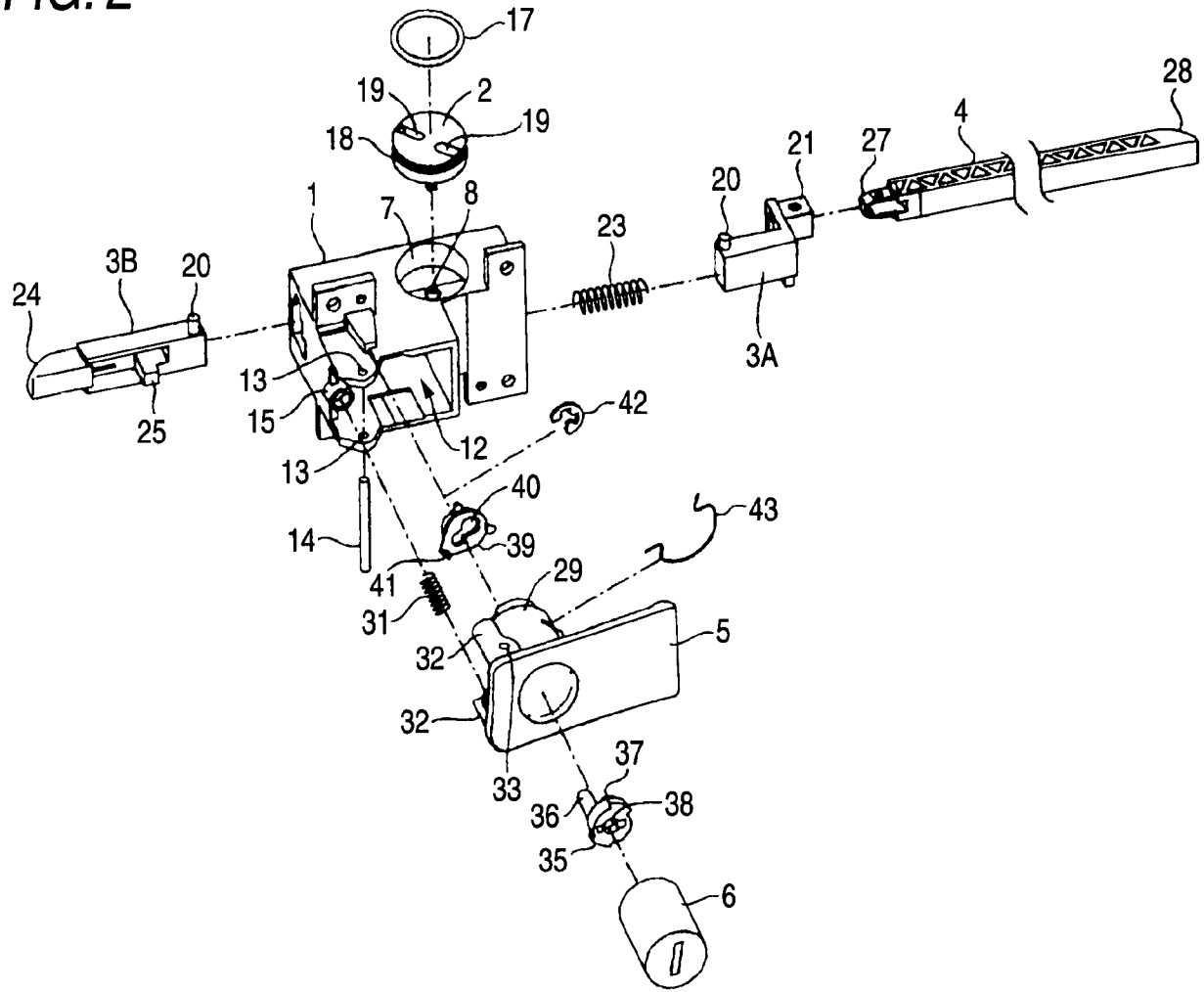
FIG. 2 is an exploded perspective view showing the side lock apparatus according to the embodiment of the invention.
Figure 3A:
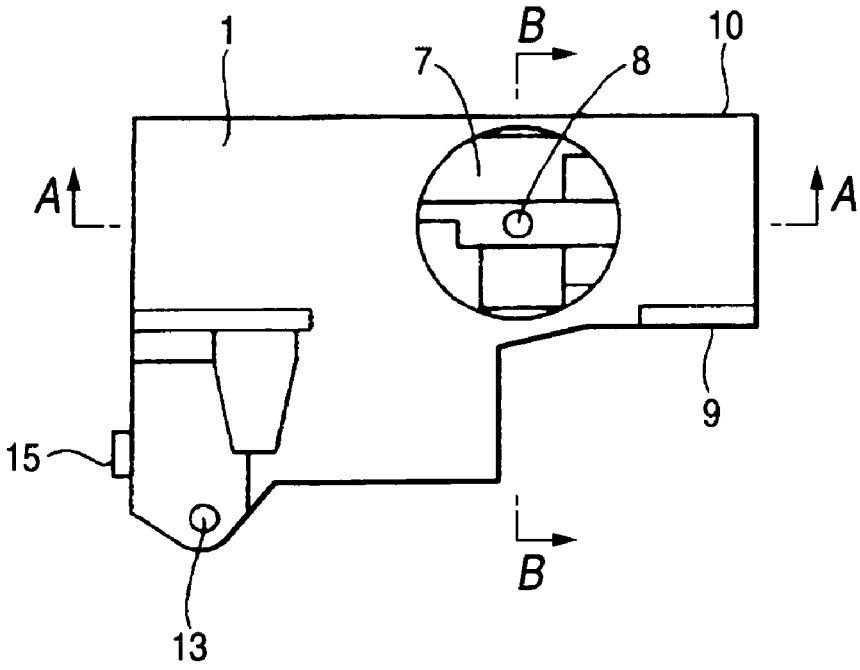
FIG. 3A is a plan view showing a housing.
Figure 3B:
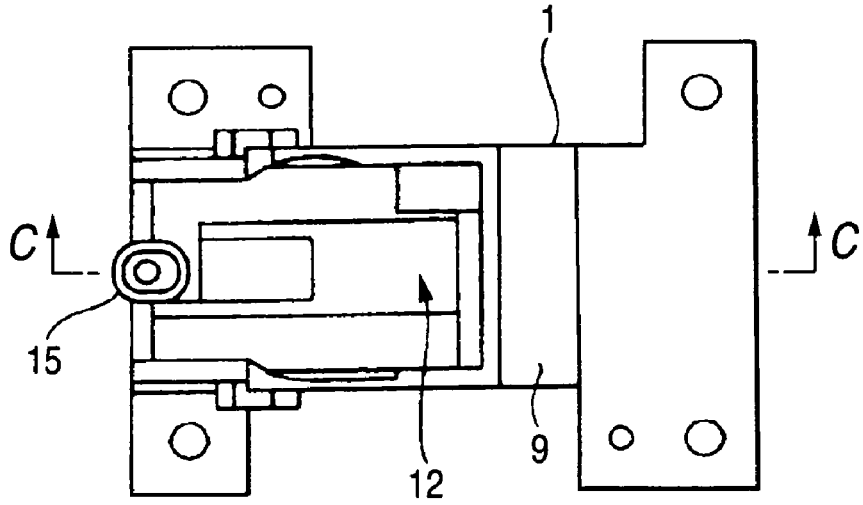
FIG. 3B is a front view thereof.
Figure 4A:
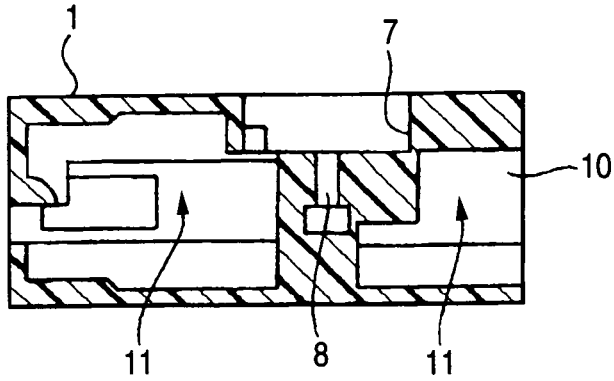
FIG. 4A is a sectional view taken along the line A-A in FIG. 3A.
Figure 4B:
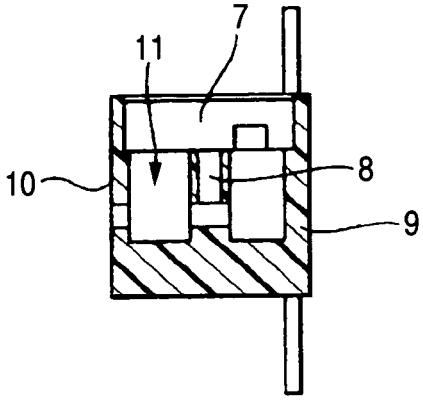
FIG. 4B is a sectional view taken along the line B-B in FIG. 3A.
Figure 4C:
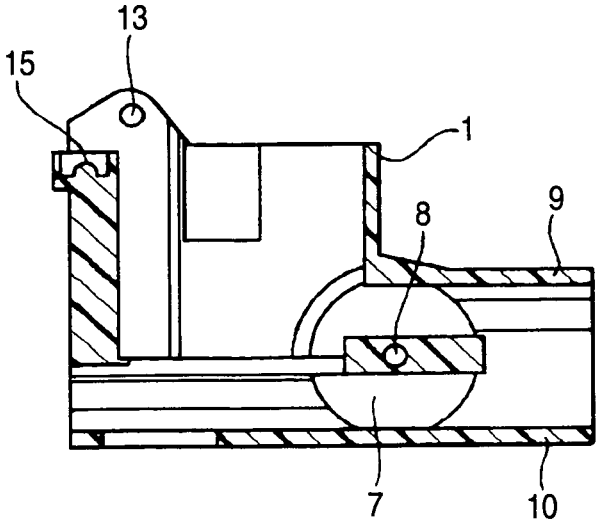
FIG. 4C is a sectional view taken along the line C-C in FIG. 3B.
Figure 5A:
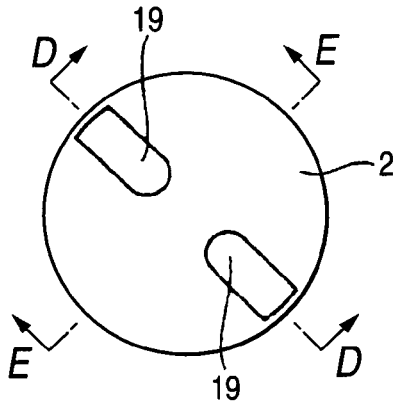
FIG. 5A is a plan view showing a rotor.
Figure 5B:
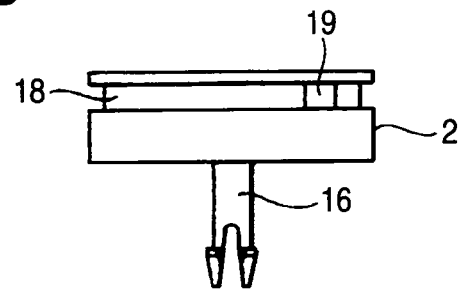
FIG. 5B is a front view thereof.
Figure 5C:
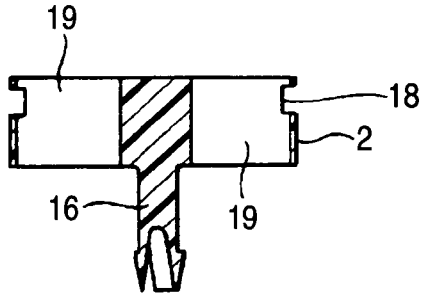
FIG. 5C is a sectional view taken along the line D-D in FIG. 5A.
Figure 5D:
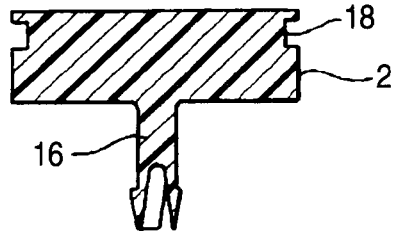
FIG. 5D is a sectional view taken along the line E-E in FIG. 5A.

To describe what has been developed in detail, as is shown in FIG. 2, the side lock apparatus according to this embodiment is made up of a box-shaped housing 1 which is fixed to a rear surface side of the short upper portion Lb of the lid L, a disc-shaped rotor 2 which is rotatably supported on the housing 1, a pair of left and right pins 3A, 3B which are linked with the rotor 2 in such a manner as to move back and forth as the rotor 2 rotates, a rod 4 which is connected to the pin 3A in such a manner as to appear from and disappear into a lock hole provided in an instrument panel side, an operation knob 5 which acts as an operation unit to forcibly withdraw the other pin 3B, and a key cylinder 6 which is mounted on the operation knob 5.

As is also shown in FIGS. 3A, 3B, 4A, 4B and 4C, the housing 1 is constructed as follows. Namely, a cylindrical portion 7 is formed in an opened state in a substantially central portion of an upper surface of the housing 1 in such a manner that a disc-shaped outer circumferential surface of the rotor 2 is brought into sliding contact therewith so as to be supported thereon, and a vertical bearing portion 8 is provided inside the cylindrical portion 7 in such a manner as to extend along the short upper portion Lb of the lid L, so that a leg portion 16 of the rotor 2, which will be described later on, is rotatably fitted in the bearing portion 8, whereby the rotor 2 can be rotatably supported in such a manner that the disc shape of the rotor 2 itself becomes horizontal relative to a wall thickness direction of the short upper portion Lb of the lid L. In addition, a first wall 9 and a second wall 10 are provided in such a manner as to face the vertical bearing portion 8 while defining a space 11 therebetween, and the pair of left and right pins 3A, 3B are supported within the space 11 defined by the first wall 9 and the second wall 10 in such a manner as to slide in an opposite direction to each other. Furthermore, an opening 12 is formed on one end portion side of a front surface of the housing 1 in such a manner that a holding cylinder 29 of the operation knob 5, which will be described later on, is allowed to face the opening 12 so formed, and shaft holes 13 are formed in upper and lower portions of the housing 1 which define the opening 12 therebetween, and a shaft 14 is passed though the shaft holes 13 and shaft holes 33 formed in mounting pieces 32 of the operation knob 5, which will be described later on, whereby the operation knob 5 is supported on the front surface of the housing 1 in such a manner as to tilt. Note that in the figures, reference numeral 15 denotes a receiving portion for a compression coil spring 31, which will be described later on.

As is also shown in FIGS. 5A, 5B, 5C and 5D, the rotor 2 is constructed as follows. Namely, the rotor 2 is formed into the disc shape and has the leg portion 16 which is fitted in the bearing portion 8 on the housing 1 side. A circumferential groove 18 is formed on a disc-shaped outer circumferential surface of the rotor 2 in which an O ring 17 is mounted, and a pair of connecting grooves 19 are provided in an opened fashion on the rotor 2 in a radial direction thereof in such a manner as to face each other across a center of the rotor 2 into which raised portions 20 provided on the pair of left and right pins 3A, 3B, which will be described later on, are made to enter in an engaged fashion with outer end of each of the connecting grooves 19 made to communicate with the circumferential groove 18. Consequently, even though the O ring 17 is compressed excessively as the length and/or thickness of the O ring 17 varies, a bottom-side diameter of the circumferential groove 18 varies, or an inside diameter of the cylindrical portion 7 of the housing 1 varies, since the O ring 17 can escape into the connecting grooves 19 which communicate with the circumferential groove 18 therefor, there occurs no case where a frictional resistance with the cylindrical portion 7 is increased. In addition, since the usage of the O ring 17 itself can help absorb uncomfortable noise that is produced as the rotor 2 rotates, this will help effectively deal with such noise.

Figure 6:
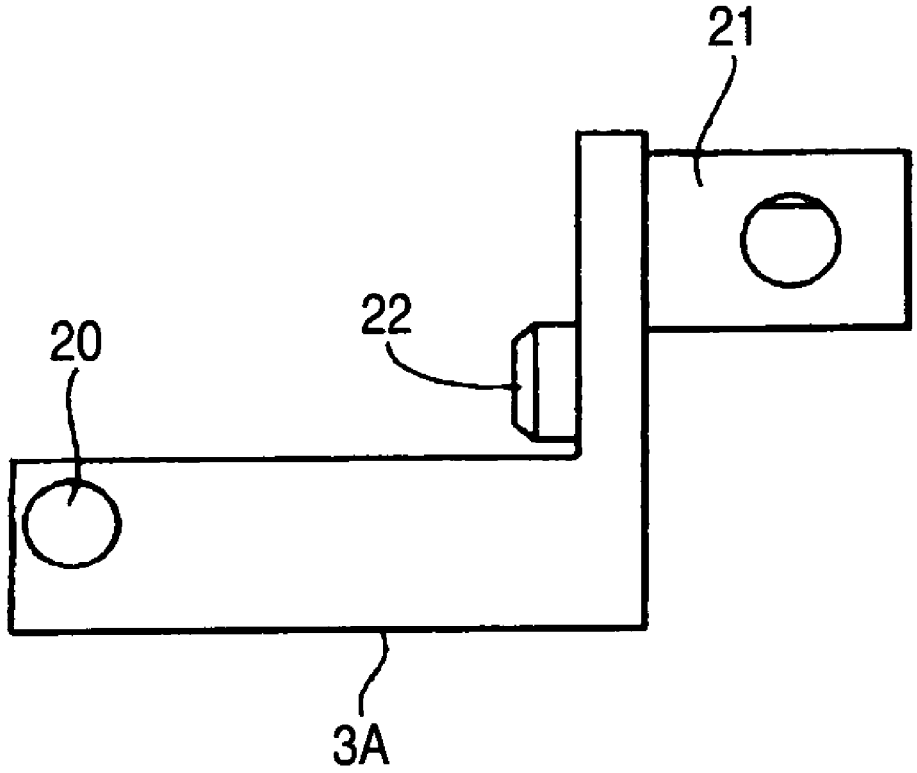
FIG. 6 is a plan view showing one of pins.

Of the pair of left and right pins 3A, 3B, the pin 3A to which the rod 4 is connected is, as is also shown in FIG. 6, molded into a crank shape, and the raised portion 20, which is to enter the connecting groove 19 of the rotor 2 in the engaged fashion, is formed at one end of the pin 3A, while a connecting portion 21 to which a proximal end portion of the rod 4 is connected is formed at the other end thereof. In addition, a receiving portion 22 for a compression coil spring 23 which biases the pair of left and right pins 3A, 3B in a direction in which the pins are made to project from the housing 1 is formed at an intermediate portion of the pin 3A.

Figure 7A:
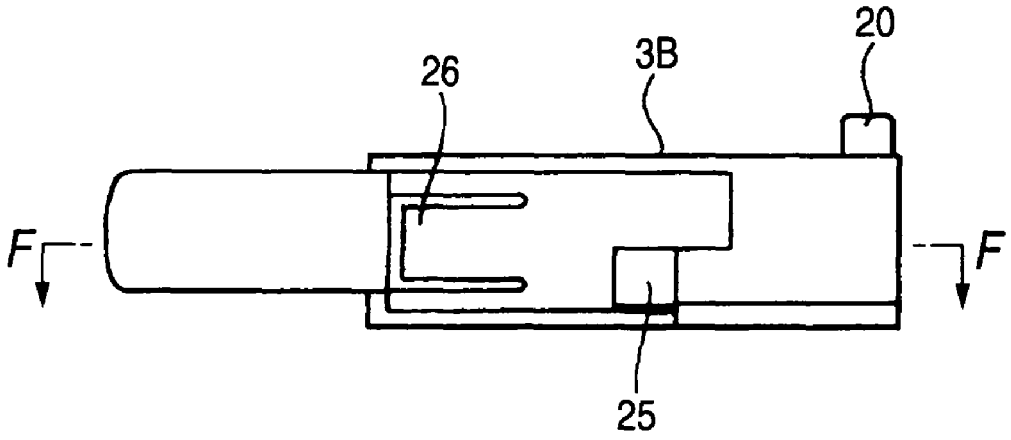
FIG. 7A is a plan view showing the other pin.
Figure 7B:
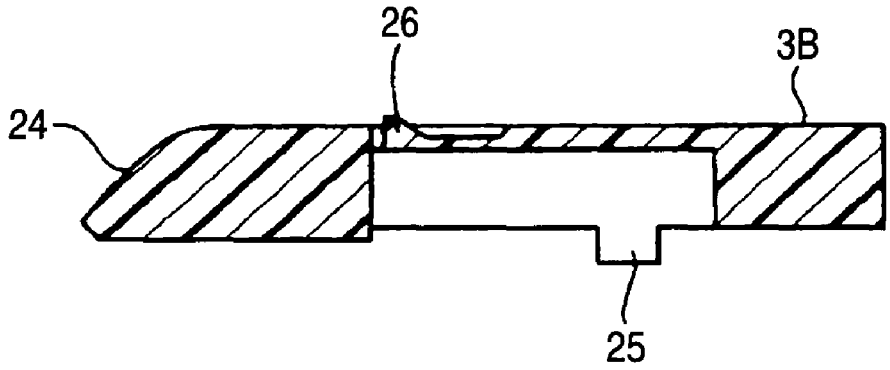
FIG. 7B is a sectional view taken along the line F-F in FIG. 7A.

In addition, as is also shown in FIGS. 7A and 7B, the other pin 3B, to which the rod 4 is not connected, is molded into a rod shape, and the raised portion 20, which is also to enter the connecting groove 19 of the rotor 2 in the engaged fashion, is formed at one end, and an inclined surface 24, which is brought into abutment with a hole edge of a lock hole formed in an instrument panel, is imparted to an end face of the other end of the pin 3B. An addition, an operation piece 25, which is to interfere with an eccentric shaft 36 of a rotational element 35, which will be described later on, is formed at an intermediate portion of the pin 3B in such a manner as to project towards a front surface side thereof, and a dislodgement preventing claw 26 is provided on a rear surface portion of the pin 3B which prevents the dislodgement of the pin 3B from the housing 1. Due to this, the other pin 3B itself doubles as a rod 4 on its side, and the other end portion of the pin 3B is made to appear from and disappear into directly the lock hole in the instrument panel.

Consequently, when the pair of left and right pins 3A, 3B are inserted from the raised portion 20 side into the space 11 defined by the first wall 9 and the second wall 10, so that the respective raised portions 20 enter the corresponding connecting grooves 19 of the rotor 2 in the engaged fashion, the pair of left and right pins 3A, 3B are biased to project outwards of the housing 1 by virtue of a spring pressure of the single compression coil spring 23. However, when the operation piece 25 of the other pin 3B is pushed inwards of the housing 1 by the eccentric shaft 36 of the rotational element 35, which will be described later on, the rotor 2 rotates in a predetermined direction in association with the relevant movement of the operation piece 25, whereby the pair of left and right pins 3A, 3B are withdrawn into the inside of the housing 1 in a synchronism with each other.

As is shown in FIG. 2, the rod 4 is constructed as follows. Namely, an elastic portion 27 is formed on the proximal end portion thereof which snap fits in the connecting portion 21 of the pin 3A, and an inclined surface 28 is imparted to an end face of a distal end portion thereof which is brought into abutment with a hole edge of a lock hole formed in the instrument panel.

Figure 8A:
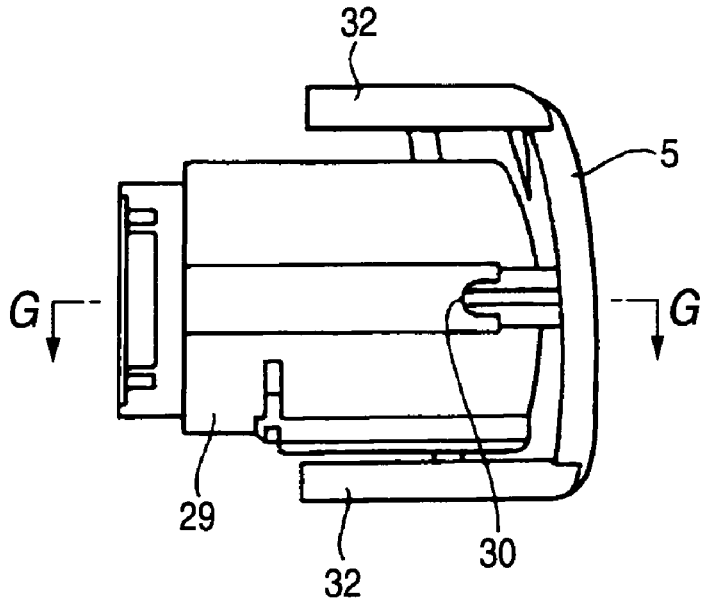
FIG. 8A is a side view showing an operation knob.
Figure 8B:
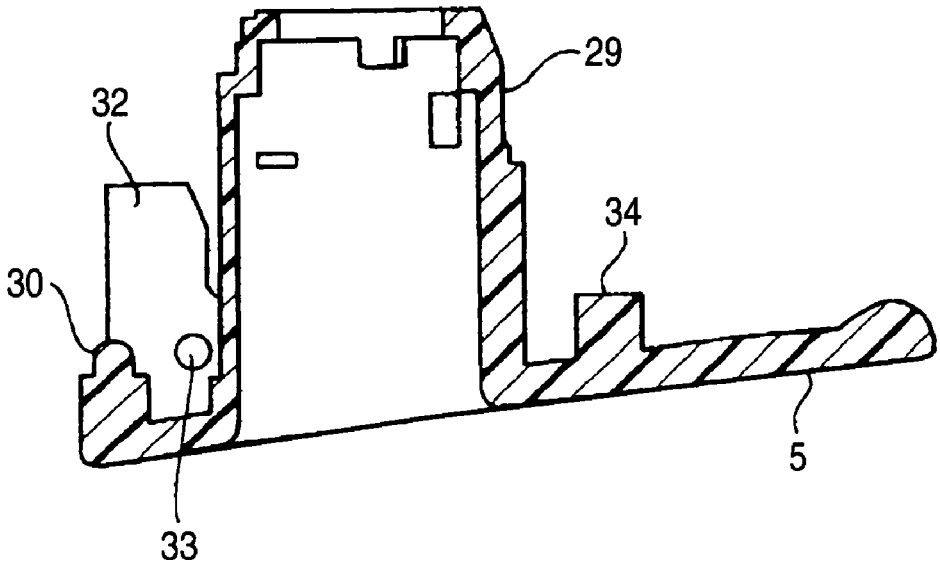
FIG. 8B is a sectional view taken along the line G-G in FIG. 8A.

The operation knob 5 is configured as a knob which is tilted horizontally, and as is also shown in FIGS. 8A and 8B, the operation knob 5 is molded into a rectangular shape as a whole, and the holding cylinder 29 for the key cylinder 6 is provided on one side thereof in such a manner as to project towards the rear of the operation knob 5. In addition, a receiving portion 30 for the compression coil spring 31 which biases the operation knob 5 in a neutral direction at all times is provided on an outside of the holding cylinder 29, and the mounting pieces 32 having the shaft holes 33 formed therein are provided in a vertical direction of the receiving portion 30. Consequently, when the shaft 14 is passed through the shaft holes 13 on the housing 1 side and the shaft holes 33 on the mounting piece 32 side while mounting the compression coil spring 31 in such a manner as to extend between the receiving portion 30 and the receiving portion 15 formed on the housing 1, the operation knob 5 itself is mounted on the housing 1 in such a manner as to tilt, and as this occurs, the other side of the operation knob 5 is biased by virtue of the spring pressure of the compression coil spring 31 in a direction towards the housing 1 until a stopper projection 34 thereof eventually collides against an edge of the opening 12 in the housing 1.

Figure 9:
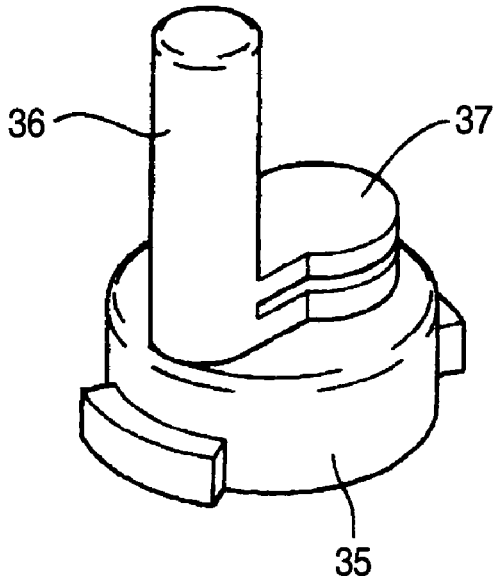
FIG. 9 is a perspective view showing a rotational element.
Figure 10:
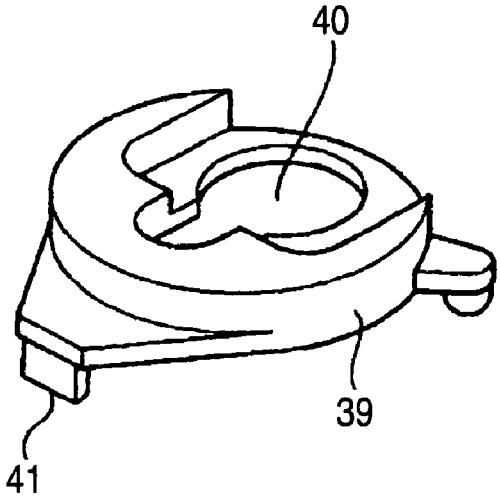
FIG. 10 is a perspective view showing a plate.
Figure 11:
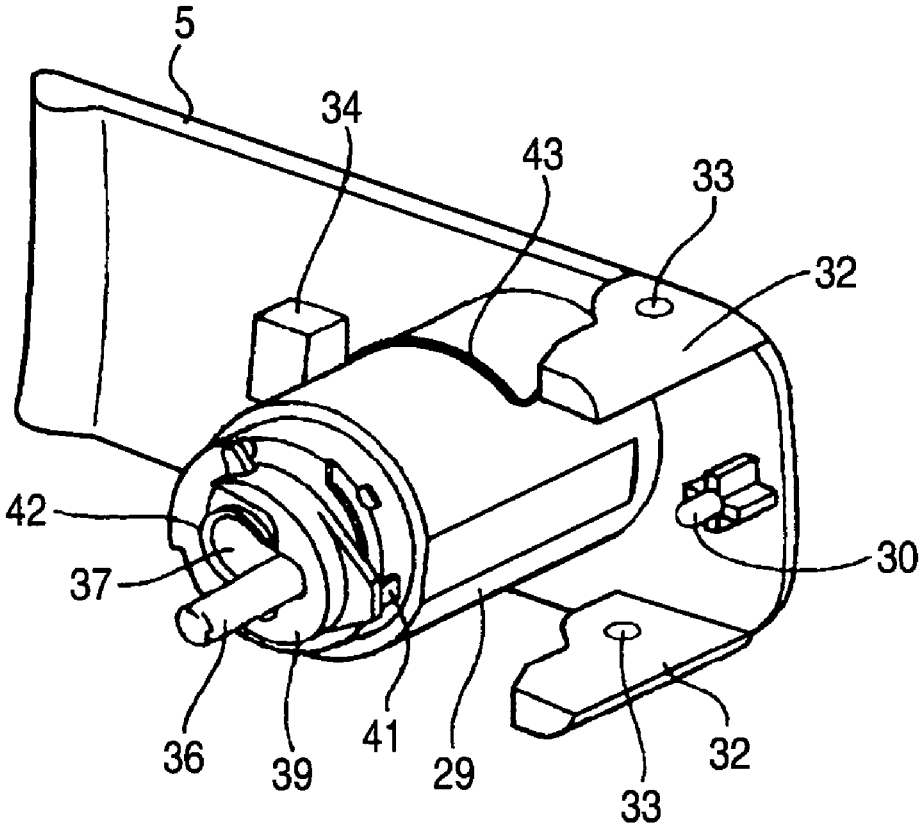
FIG. 11 is a perspective view showing a state in which the rotational element and the plate are mounted on a distal end of a holding cylinder of the operation knob.

In addition, the rotational element 35 having the eccentric shaft 36 is rotatably supported on a distal end portion of the holding cylinder 29 via a plate 39. However, as is also shown in FIG. 9, on the rotational element 35, the eccentric shaft 36 and a circular post portion 37 which is larger in diameter but shorter in height than the eccentric shaft 36 are formed on one surface side of a base plate thereof in such a manner as to be deviated from each other, while an engagement groove 38, which is brought into engagement with a drive shaft (not shown) of the key cylinder 6, is formed on the other surface side of the base plate. On the plate 39, as is also shown in FIG. 10, a teardrop-shaped hole 40 is formed in a central portion of the plate into which the eccentric shaft 36 and the circular post portion 37 are fitted, and a hook piece 41 is formed on a circumferential edge thereof in such a manner as to be hooked on a distal end edge of the holding cylinder 29, whereby, as is shown in FIG. 11, the rotational element 35 and the plate 39 are configured so as to be rotatably mounted on the holding cylinder 29 of the operation knob 5 via an E ring 42.

Consequently, when the key cylinder 6 is locked and unlocked in such a state the key cylinder 6 is mounted inside the holding cylinder 29 of the operation knob 5 so that the drive shaft of the key cylinder 6 is brought into engagement with the engagement groove 38 of the rotational element 35, the eccentric shaft 36 of the rotational element 35 rotates between a position where the eccentric shaft 36 interferes with the operation piece 25 provided at the intermediate portion of the other pin 3B and a position where the eccentric shaft does not interfere with the operation piece 25.

Figure 12:
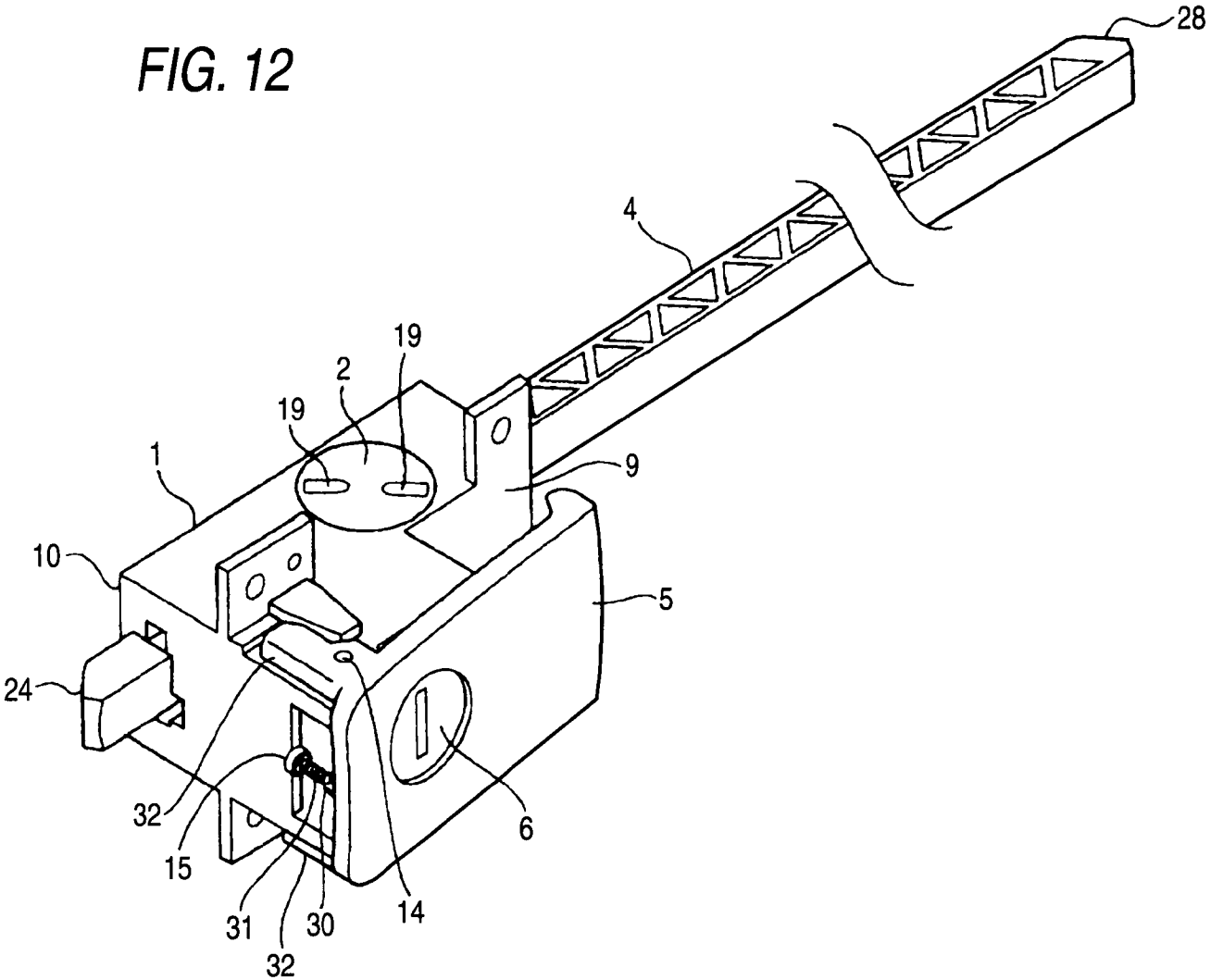
FIG. 12 is a perspective view showing a state in which the side lock apparatus according to the embodiment of the invention is assembled into a unit.

Thus, when assembling the component parts of the side lock apparatus that are configured as have been described heretofore, firstly, the pin 3A to which the rod 4 is connected is inserted into the space 11 defined by the first wall 9 and the second wall 10 while the compression coil spring 23 is mounted thereon in such a manner as to be interposed between the pins 3A, 3B in the end, and at the same time, the other pin 3B is also inserted into the space 11 defined by the first wall 9 and the second wall 10 in the same manner as it is. Thereafter, while bringing the respective raised portions 20 of the pints 3A, 3B into engagement with the corresponding connecting grooves 19 of the rotor 2, the rotor 2 is rotatably supported within the cylindrical portion 7 in the housing 1 via the bearing portion 8 and the leg portion 16, and the rotational element 35 and the plate 39 are mounted on the distal end of the holding cylinder 29 of the operation knob 5 via the E ring 42, the key cylinder 6 being fixed in place within the holding cylinder 29 via a wire 43. Thereafter, when the operation knob 5 is rotatably supported on the housing 1 side, the side lock apparatus, which has been completed as a unit or module as shown in FIG. 12, is assembled on to the housing 1 side.

Figure 13:
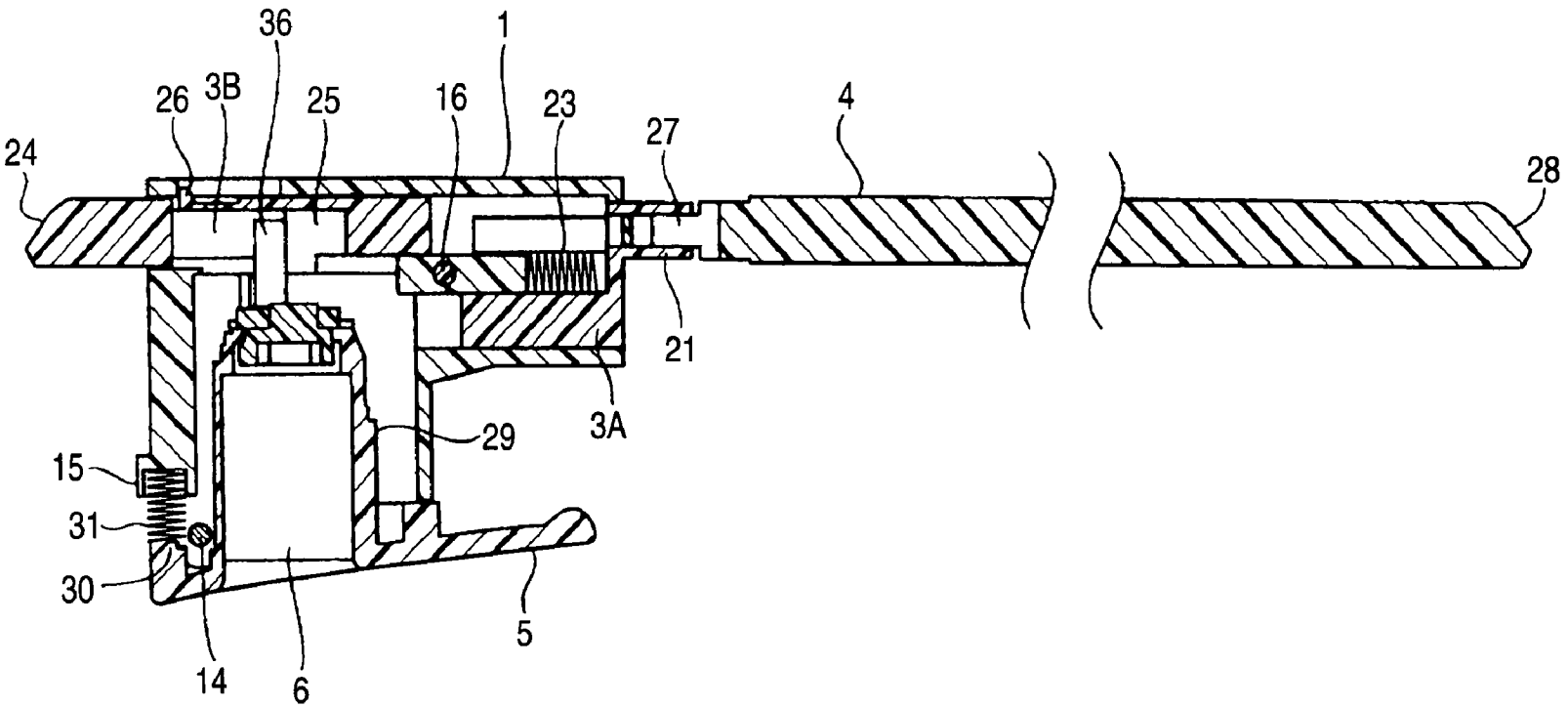
FIG. 13 is a horizontal sectional view showing the assembled state.

Then, when mounting the operation knob 5 on the housing 1 side in such a manner as to tilt, as is shown in FIG. 13, the holding cylinder 29 is positioned on the side of one of the pair of left and right pins 3A, 3B which lies farther away from the surface of the lid L, that is, the other pin 3B, by making use of the existence of the opening 12, and the operation piece 25 of the other pin 3B is made to interfere with the eccentric shaft 36 of the rotational element 35. Due to this, in this embodiment, since the operation knob 5 can be disposed by making use of a space on the rear surface of the short upper portion Lb of the lid L, the operation knob 5 inadvertently projects in no case from the surface of the lid L, and the operation knob 5 is made to interfere with the other pin 3B at a location lying away from the tilting center thereof, whereby a large lever ratio can be obtained so as to ensure the opening of the lid L.

Consequently, when the housing 1 is thereafter fastened to the rear surface of the short upper portion Lb of the lid L with screws, the side lock apparatus becomes available for actual use. In this case, due to the reason that the rotor 2 is placed in the horizontal state, the lock system itself can be made as much as compact in the vertical direction, and therefore, the side lock apparatus becomes optimum for the lid L which has, as viewed in the vertical section thereof, the long lower portion La and the short upper portion Lb which continues from the long lower portion La while bending therefrom. In addition, in this embodiment, due to the reason that the rotor 2 having no gear is used to replace the conventional pinion gear, there is caused no fear that the pair of left and right pins 3A, 3B are assembled erroneously, and since the rotor 2 is brought into sliding contact with the cylindrical portion 7 in the housing so as to be supported thereby, the rotor 2 is never inclined inadvertently during operation.

Figure 14:
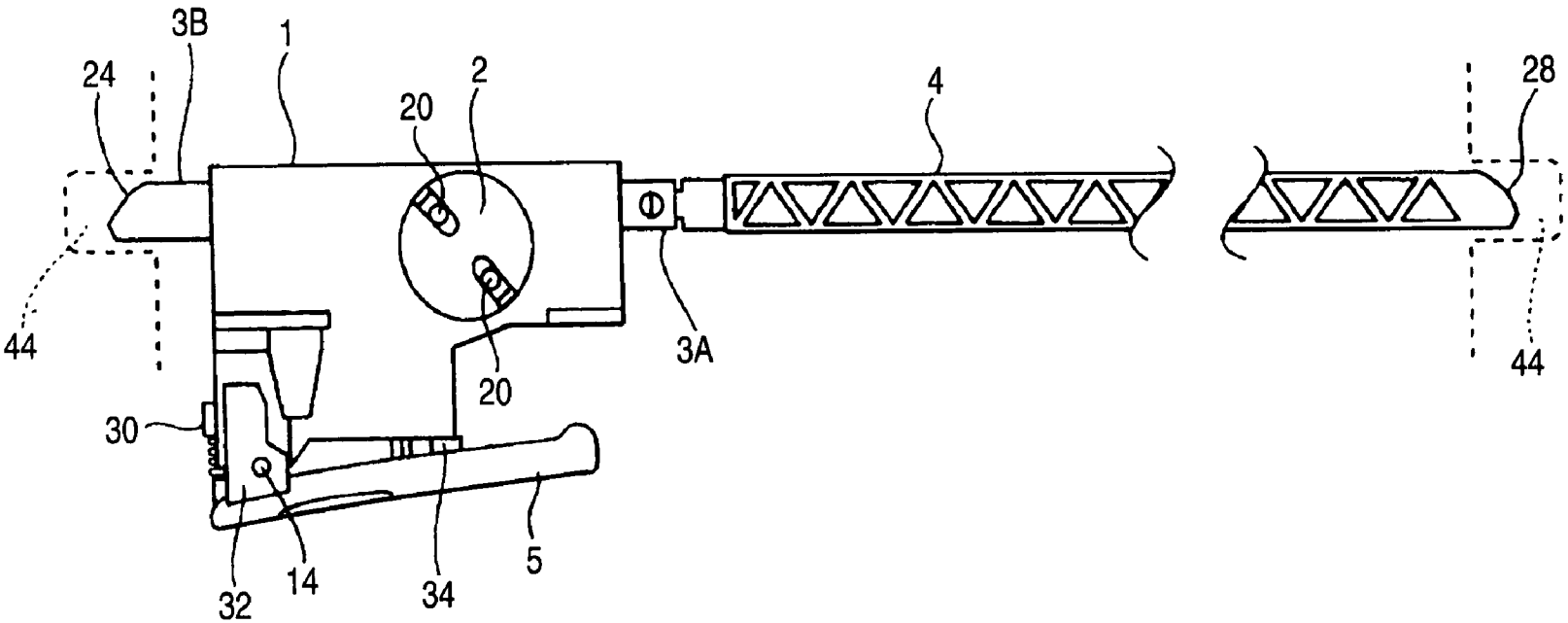
FIG. 14 is a plan view showing a state in which a glove box is locked in its closed state.

Then, in an actual use, when the glove box main body B is in a closed state, as is shown in FIG. 14, since the distal end portion of the other pin 3B and the distal end portion of the rod 4 which is connected to the pin 3A stay in the corresponding left and right lock holes 44 in the instrument panel (not shown) in the engaged fashion by the action of the compression coil spring 23, the glove box itself is locked in its closed position. In addition, in this case, when the key cylinder 6 is locked, although not shown specifically, the eccentric shaft 36 of the rotational element 35 rotates to the position where the eccentric shaft 36 does not interfere with the operation piece of the other pin 3B, whereby, even though the operation knob 5 is operated to open or close the glove box, since the operation force is not transmitted to the other pin 3B side, there occurs no case where the glove box main body B is opened erroneously.

Figure 15:
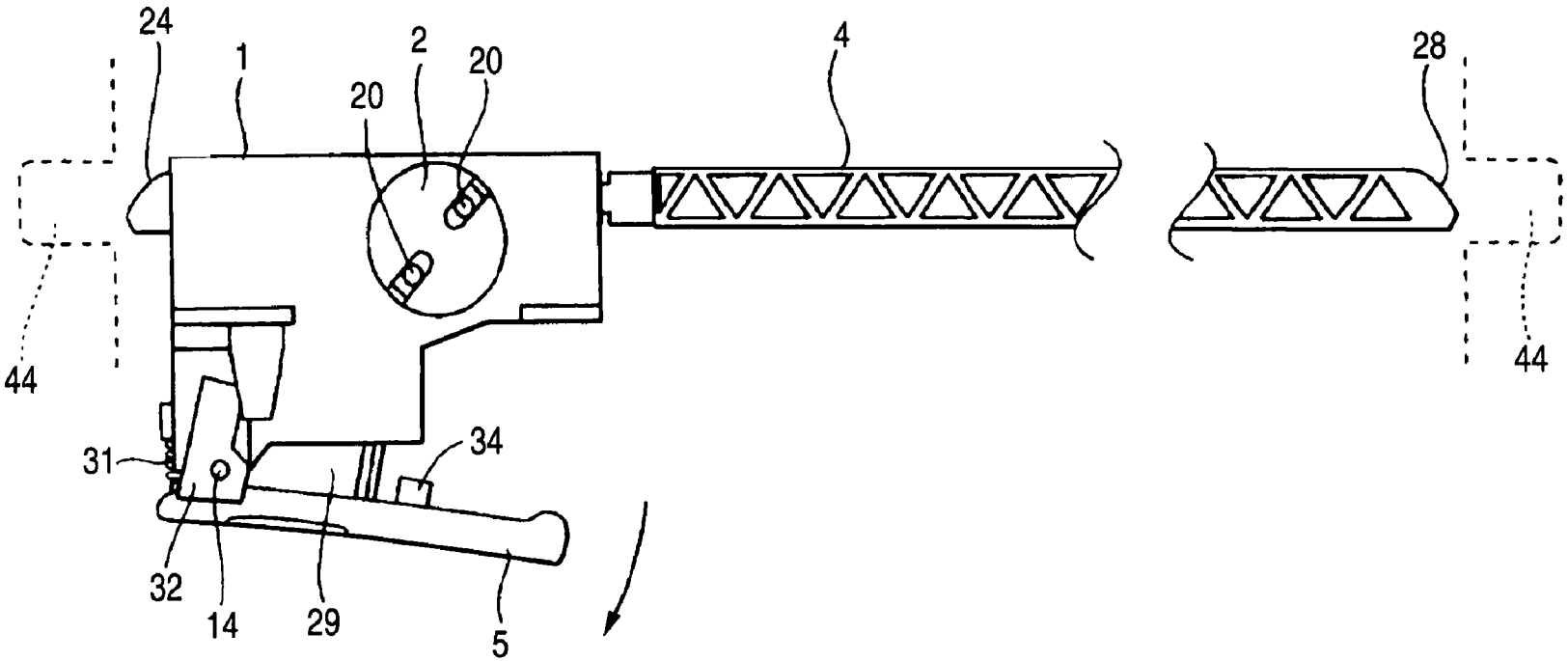
FIG. 15 is a plan view showing a state in which the locking of the glove box is released.

When the locked state is released to open the glove box, with the key cylinder 6 locked, the key cylinder 6 is unlocked so that the eccentric shaft 36 of the rotational element 35 is allowed to rotate to the position where the eccentric shaft 36 interferes with the operation piece 25 of the other pin 3B, in which state when the operation knob 5 is tilted in a direction indicated by an arrow in FIG. 15, since this time, the eccentric shaft 36 of the rotational element 35 withdraws the other pin 3B inwards of the housing 1 against the spring pressure of the compression coil spring 23, the rotor 2 rotates in association with the withdrawal of the other pin 3B, so that the pin 3A is also withdrawn inwards of the housing 1 against the spring pressure of the compression coil spring 23, causing the rod 4 connected to the pin 3A to be also withdrawn accordingly, whereby as is shown in FIG. 15, the distal end portion of the other pin 3B and the distal end portion of the rod 4 are withdrawn from the corresponding lock holes 44, thereby making it possible to move the glove box main body B in the opening direction.

On the contrary, in closing the opened glove box, when the glove box main body B is rotated towards the instrument panel side, the inclined surface 24 of the other pin 3B and the inclined surface 28 of the rod 4 are brought into abutment with the hole edges of the locking holes 44, whereby the other pin 3B and the rod 4 are pushed back against the spring pressure of the compression coil spring 23, whereby when the other pin 3B and the rod 4 reach the lock holes 44, the pin and the rod enter again the lock holes 44 in the engaged fashion, and therefore, the glove box main body B is locked in its closed position.

With the side lock apparatus according to the invention, due to the reason that the rotor is adopted to replace the conventional pinion gear, there is caused no fear that the pair of left and right pins (rods) are assembled erroneously, and due to the reason that the cylindrical portion is provided in the housing which is brought into sliding contact with the disc-shaped outer circumferential surface of the rotor to support the rotor, since the rotor is never inclined during operation, it will be remarkably convenient when the side lock apparatus is applied to a glove box itself which is mounted on an instrument panel side of a motor vehicle in such a manner as to be opened and closed or an independent lid thereof.

What is claimed is:

1. A side lock apparatus for opening and closing a lid, the side lock apparatus comprising:

a disk shaped rotor;

a housing which is fixed to the lid, the housing including:

a cylindrical portion provided to hold the rotor;

a bearing portion provided to rotatably support the rotor;

a first wall provided at one side of the bearing portion to define a first space therebetween; and a second wall provided at the other side of the bearing portion to define a second space therebetween, the second wall being positioned farther from a front surface of the lid as compared with the first wall;

a pair of pins which are linked with each other to move in an opposite direction through a rotation of the rotor, a first pin of the pins being slidably inserted in the first space, and a second pin of the pins being positioned farther from the front surface of the lid as compared with the first pin and being slidably inserted in the second space; and a knob having a substantially L-shape including:

a first side that is attached to the housing so as to be exposed on a front surface side of the lid; and a second side that substantially perpendicularly extends from the first side so as to be connected with the second pin at a position farther from the lid.

2. The side lock apparatus according to claim 1, wherein the rotor includes:

a disk shaped portion that is rotatably held by the cylindrical portion of the housing;

a leg portion that projects from the disc-shaped portion and that is rotatably supported by the bearing portion of the housing;

a circumferential groove that is formed along a circular outer surface of the disc-shaped portion of the rotor, to which an O-ring is attached; and a pair of connecting grooves that are formed on one surface of the disk-shaped portion of the rotor, and wherein the circumferential groove is communicated with the connecting grooves, so that the O-ring is allowed to deformingly enter into the connecting grooves to thereby absorb a mismatch in size between the circumferential groove and the O-ring.

3. The side lock apparatus according to claim 1, wherein the rotor further comprises a leg portion.

4. The side lock apparatus according to claim 3, wherein the leg portion is configured to be rotatably fitted in the bearing portion.

5. The side lock apparatus according to claim 3, wherein the bearing portion comprises a bearing hole, and wherein the leg portion is configured to be rotatably fitted in the bearing hole.

6. The side lock apparatus according to claim 1, wherein the pair of connecting grooves face each other across a center of the rotor.

7. The side lock apparatus according to claim 1, wherein the pair of connecting grooves receive a raised portion formed on the pair of pins.

8. The side lock apparatus according to claim 1, wherein one of the pair of pins has a crank-shape.

9. The side lock apparatus according to claim 8, wherein the one of the pair of pins having the crank-shape has the raised portion at a first end and a connecting portion at a second end, said connecting portion configured to connect to a rod.

10. The side lock device according to claim 1, wherein one of the pair of pins comprises a rod shape having the raised portion at a first end and an inclined surface at a second end.

11. The side lock apparatus according to claim 10, wherein another of the pair of pins comprises a rod shape having the raised portion at a first end and an inclined surface at a second end.

12. The side lock apparatus according to claim 1, further comprising a rod configured to abut an instrument panel to which the lid is attached, said rod comprising:

an elastic portion at a first end of the rod, which connects to one of the pair of pins; and an inclined surface at a second end of the rod that abuts the instrument panel.

13. The side lock apparatus according to claim 1, wherein the knob is tiltedly supported on the housing.

14. The side lock apparatus according to claim 1, wherein the rotor is aligned so that the disc shape of the rotor is perpendicular to a plane in which a wall of the lid extends.

15. The side lock apparatus according to claim 1, wherein the knob further comprises a key cylinder which rotates the second side so as to engage and disengage the second side with the second pin.

* * * * *